US006623574B1

(12) United States Patent
Wu

(10) Patent No.: US 6,623,574 B1
(45) Date of Patent: Sep. 23, 2003

(54) GAS GENERATOR COMPOSITION

(75) Inventor: Jianzhou Wu, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/530,185

(22) PCT Filed: Sep. 28, 1999

(86) PCT No.: PCT/JP99/05296

§ 371 (c)(1),
(2), (4) Date: Apr. 26, 2000

(87) PCT Pub. No.: WO00/18705

PCT Pub. Date: Apr. 6, 2000

(30) Foreign Application Priority Data

Sep. 28, 1998 (JP) ..... 10-273206

(51) Int. Cl.[7] ..... C06B 45/10

(52) U.S. Cl. ..... 149/19.91; 149/36; 149/46; 149/60

(58) Field of Search ..... 149/19.7, 36, 46, 149/60, 19.91; 280/741

(56) References Cited

U.S. PATENT DOCUMENTS

| | | | | | |
|---|---|---|---|---|---|
| 2,936,225 | A | * | 5/1960 | Linsk et al. | 149/19.7 |
| 3,020,180 | A | * | 2/1962 | Morello | 149/19.7 |
| 3,214,305 | A | * | 10/1965 | Bowman et al. | 149/19.7 |
| 3,653,993 | A | * | 4/1972 | Batchelder et al. | 149/19.91 |
| 3,986,908 | A | * | 10/1976 | Grebert et al. | 149/19.7 |
| 4,214,438 | A | * | 7/1980 | Hamilton et al. | 149/19.6 |
| 4,369,079 | A | | 1/1983 | Shaw | |
| 4,909,549 | A | | 3/1990 | Poole et al. | |
| 5,139,588 | A | * | 8/1992 | Poole | 149/61 |
| 5,472,647 | A | * | 12/1995 | Blau et al. | 149/19.92 |
| 5,482,579 | A | * | 1/1996 | Ochi et al. | 149/83 |
| 5,486,248 | A | | 1/1996 | Taylor et al. | |
| 5,545,272 | A | | 8/1996 | Poole et al. | |
| 5,596,168 | A | | 1/1997 | Menke et al. | |
| 5,725,699 | A | * | 3/1998 | Hinshaw et al. | 149/19.1 |
| 5,868,424 | A | * | 2/1999 | Hamilton et al. | 149/2 |
| 5,872,329 | A | * | 2/1999 | Burns et al. | 149/36 |
| 5,962,808 | A | * | 10/1999 | Lundstrom et al. | 149/19.1 |
| 6,019,861 | A | * | 2/2000 | Canterberry et al. | 149/19.1 |
| 6,033,500 | A | * | 3/2000 | Ito et al. | 149/36 |
| 6,120,058 | A | | 9/2000 | Mangum et al. | |
| 6,143,103 | A | * | 11/2000 | Ryder | 149/46 |
| 6,156,136 | A | * | 12/2000 | Bottaro et al. | 149/19.1 |

FOREIGN PATENT DOCUMENTS

| | | |
|---|---|---|
| WO | A1-9627574 | 9/1996 |
| WO | A-9842642 | 10/1998 |

* cited by examiner

*Primary Examiner*—Edwatd A. Miller
(74) *Attorney, Agent, or Firm*—Birch, Stewart, Kolasch & Birch, LLP

(57) ABSTRACT

A gas generating composition which is excellent in a combustion efficiency and a gas output and in which amounts of residues generated are reduced in the combustion is obtained.

A gas generating composition comprising (a) 5 to 40% by weight of at least one high polymer selected from the group consisting of a polyacrylic derivative resin, a polyacetal, a urea resin, a melamine resin, a ketone resin and a cellulose-based high polymer, and (b) 60 to 95% by weight of ammonium nitrate or phase-stabilized ammonium nitrate. It is suitable as a gas generating agent for an air bag of automobiles.

7 Claims, No Drawings

GAS GENERATOR COMPOSITION

This application is the national phase under 35 U.S.C. §371 of PCT International Application No. PCT/JP99/05296 which has an International filing date of Sep. 28, 1999, which designated the United States of America.

TECHNICAL FIELD TO WHICH THE INVENTION BELONGS

This invention relates to a gas generating composition which is suited for an air bag restraining system of automobiles, and an inflator for an air bag using the same.

PRIOR ART

As a gas generating agent for an air bag as a passenger protecting device in automobiles, gas generating agents containing various nitrogen-containing organic compounds being safer non-azide compound fuels that replace sodium azide have been developed.

For example, U.S. Pat. No. 4,909,549 discloses a composition of hydrogen-containing tetrazole and triazole compounds and an oxygen-containing oxidizing agent; U.S. Pat. No. 4,369,079 discloses a composition of a hydrogen-free bitetrazole metal salt and an oxygen-containing oxidizing agent; and JP-A 6-239683 discloses a composition of carbohydrazide and an oxygen-containing oxidizing agent. Most of these non-azide gas generating compositions are made of nitrogen-containing organic compound fuels such as tetrazole, a bitetrazole metal salt, triazole, carbohydrazide and the like and oxidizing agents such as potassium nitrate, strontium nitrate, potassium perchlorate and the like.

Further, U.S. Pat. No. 5,545,272 discloses a gas generating composition of ammonium nitrate phase-stabilized with 7 to 20% by weight of a potassium salt and nitroguanidine; WO 96/27574 discloses a gas generating agent of a composition of nitroguanidine, phase-stabilized ammonium nitrate and a rubber-like binder; JP-A 7-330477 discloses a gas generating composition of acrylate-terminated polybutadiene, polybutadiene polycarboxylic acid, epoxy-modified polybutadiene, a curing agent and an oxidizing agent; JP-A 6-92770 discloses a gas generating composition especially containing an organic binder generating an azide group, an active plasticizer and an oxidation filler, the binder being made of a reaction product of polyglycidyl azide having a hydroxyl group and at least one polyisocyanate, and at least 85% by weight of the oxidation filler being ammonium nitrate; and JP-A 10-72273 discloses a gas generating agent made of ammonium nitrate, a reducing agent which is at least one of tetrazole, aminotetrazole, bitetrazole, a bitetrazole metal salt, bitetrazole ammonium salt, nitroguanidine, guanidine nitrate, dicyandiamide and the like, and a combustion controlling agent such as copper oxide, manganese dioxide or the like.

However, an amount of a gas generated per 100 g of the azide gas generating agent is 1.5 mol or less, and an amount of a gas generated per 100 g of a non-azide gas generating agent that does not use ammonium nitrate is 2.5 mol or less. Thus, in either case, there is a problem that a gas output is low. Further, large amounts of residues are generated in the combustion. Accordingly, when residues generated are released as such from an inflator, high-temperature liquid or solid residues might damage a bag and a bag might be separated from an air bag module or burned. In addition, it is sometimes harmful in breathing of passengers. In order to prevent the release of combustion residues from an inflator as much as possible, there is a method in which a large amount of a filter is packed in an inflator. However, this method is against downsizing of an inflator and reduction of its weight, and also increases the production cost.

Moreover, the gas generating composition of phase-stabilized ammonium nitrate and nitroguanidine disclosed in U.S. Pat. No. 5,545,272 and WO 96/27574 provides a high gas output and reduces amounts of residues generated. However, phase-stabilized ammonium nitrate and nitroguanidine form a low eutectic product, and the melting temperature thereof is as low as 120° C. or less. Thus, the gas generating agent might be melted during the welding step in the production of an inflator. Besides, the composition containing phase-stabilized ammonium nitrate and nitroguanidine has a high initiation sensitivity, which is problematic in the safety of the production of the gas generating agent.

Moreover, the gas generating composition made of ammonium nitrate, tetrazoles and a metal oxide, disclosed in JP-A 10-72273, is hard to mold because of the absence of a high polymer, and cannot endure a volume change when a phase of ammonium nitrate is changed, making it difficult to control combustion of the gas generating agent after the lapse of a long period of time.

Besides, gas generating agents in which an energy binder such as an azide polymer or the like and ammonium nitrate or phase-stabilized ammonium nitrate are used and amounts of residues generated are reduced are disclosed (for example EP 705809). However, these gas generating agents are problematic in that a large amount of hazardous carbon monoxide is generated in the combustion. Further, since a burning rate is low, it is difficult to simply apply the same to gas generating agents for an air bag of automobiles.

DISCLOSURE OF THE INVENTION

An object of this invention is to provide, upon solving the above-described problems, a gas generating composition which is excellent in a combustion efficiency and a gas output and in which amounts of residues generated are reduced in the combustion.

Another object of this invention is to provide an inflator for an air bag using the above-described gas generating composition.

This invention provides a gas generating composition comprising (a) 5 to 40% by weight of at least one high polymer selected from the group consisting of a polyacrylic derivative resin, a polyacetal, a urea resin, a melamine resin, a ketone resin and a cellulose-based high polymer, and (b) 95 to 60% by weight of ammonium nitrate or phase-stabilized ammonium nitrate.

Further, this invention provides an inflator for an air bag using the above-described gas generating composition.

The gas generating composition of this invention has a low toxicity and a high safety, is easy to handle, and is excellent in a combustion efficiency and a gas output, and amounts of residues generated are reduced. Accordingly, the gas generating composition of this invention is suitable as a gas generating agent for an air bag as a passenger protecting device in automobiles. Further, since the gas generating composition of this invention has a high thermal stability, an inflator for an air bag using the same can maintain a stable performance for a long period of time and can be downsized more.

PREFERRED EMBODIMENTS OF THE INVENTION

The high polymer as component (a) used in this invention is a component that acts as both a fuel and a binder in the gas generating composition.

With respect to the high polymer as component (a), in view of an oxygen balance and a combustibility of the high polymer, its thermal stability in the mixing with ammonium nitrate and the like, one type or a combination of two or more types selected from the group consisting of a polyacrylic derivative resin, a polyacetal, a urea resin, a melamine resin, a ketone resin and a cellulose-based high polymer which are solid in the use temperature range (−30° C. to 90° C.) of the gas generating agent can be proposed. Component (a) is described in detail below.

(1) Polyacrylic Derivative Resin

Polyacrylamide ($LD_{50}$ (peroral, mouse) is 1,200 mg/kg or more and there is no mutagenicity), aminated polyacrylamide, polyacrylhydrazide ($LD_{50}$ (peroral, mouse) is 3,800 mg/kg and there is no mutagenicity), a copolymer of acrylamide and ammonium acrylate, a copolymer of acrylamide and an acrylic acid metal salt, a copolymer of acrylamide and an acrylic acid ester compound and the like can be proposed.

As these polyacrylic derivative resins, the following compounds (i) to (v) are preferable.

(i) $(CH_2CHCONH_2)_n$ (ii) $(CH_2CHCONHNH_2)_n$ (iii) $(CH_2CHCONH_2)_n—(CH_2CHCONHNH_2)_p$ (iv) $(CH_2CHCONH_2)_n—(CH_2CHCOOM)_q$ (v) $(CH_2CHCONH_2)_n—(CH_2CHCOOR)_s$

[wherein M represents a metal ion such as ammonium, sodium or potassium; R represents a group such as $C_2H_4—N(CH_3)_2$ or the like; and n, p, q and s each represents a degree of polymerization, n being in the range of 10,000 to 400,000 and p, q and s being in the range of 5,000 to 100,000].

(2) Polyacetal, Urea Resin, Melamine Resin and Ketone Resin

Since polyacetal (another name: polyformaldehyde) is excellent in a thermal stability and a chemical resistance and contains a large amount of oxygen (53.3% by weight), a combustibility is excellent. Further, since its melting point is close to a melting point of ammonium nitrate, it can be melted with ammonium nitrate and other additives to conduct molding. A urea resin and a melamine resin are, like a polyacetal, excellent in a combustibility, a thermal stability and a chemical resistance.

(3) Cellulose-based High Polymer

Cellulose acetate, carboxymethyl cellulose, ammonium carboxymethyl cellulose, sodium carboxymethyl cellulose, potassium carboxymethyl cellulose and the like can be proposed.

As component (a), among the compounds (1) to (3), polyacrylamide is especially preferable.

Component (b) used in this invention is ammonium nitrate or phase-stabilized ammonium nitrate. Ammonium nitrate is often used in a fertilizer, an explosive or the like, and comprises nitrogen, oxygen and hydrogen. Accordingly, solid residues are not generated in the combustion. Ammonium nitrate can directly be used as an oxidizing agent. However, since the range of the use temperature includes some phase transition points, it is preferable to use the same as phase-stabilized ammonium nitrate by adding a small amount of a potassium salt or other additives.

When the gas generating composition of this invention is a two-component type of components (a) and (b), the content of component (a) in the gas generating composition is between 5 and 40% by weight, preferably between 5 and 30% by weight, and the content of component (b) is between 95 and 60% by weight, preferably between 90 and 65% by weight.

The gas generating composition of this invention can further contain one or more combustion accelerating agents selected from bitetrazole salts as component (c).

Examples of the combustion accelerating agent as component (c) can include bitetrazole metal salts and non-metal salts such as bitetrazole sodium salt, bitetrazole potassium salt, bitetrazole ammonium salt, bitetrazole calcium salt, bitetrazole manganese salt, bitetrazole zinc salt, bitetrazole cobalt salt, bitetrazole guanidine, bitetrazole melamine and the like. Of these, bitetrazole potassium salt is preferable because the effect of accelerating the burning rates of components (a) and (b) is greater than that of the accelerating agent such as potassium perchlorate, calcium nitrate or the like in the same amount and the amounts of solid residues generated after the combustion are reduced. In addition, phase-stabilized ammonium nitrate is formed with ammonium nitrate as component (b) and the volume change of the gas generating composition can be prevented in the use temperature range.

When the gas generating composition of this invention is a three-component type of components (a), (b) and (c), the content of component (a) is preferably between 1 and 40% by weight, more preferably between 5 and 30% by weight, the content of component (b) is preferably between 60 and 94% by weight, more preferably between 65 and 90% by weight, and the content of component (c) is preferably between 0.5 and 15% by weight, more preferably between 3 and 15% by weight. When the content of component (c) is in the above-described range, a molding strength is good. When a bitetrazole metal salt is used as component (c), amounts of combustion residues can also be reduced.

The gas generating composition of this invention can contain, for controlling a burning rate, one or more types selected from carbon and a metallic powder as a burning rate controlling agent (d) as required. Examples of the metallic powder used as the burning rate controlling agent of component (d) can include an aluminum powder, a boron powder, an iron powder, a magnesium powder and the like. The content of component (d) in the gas generating composition is preferably between 0.01 and 5% by weight, more preferably between 0.01 and 3% by weight.

The gas generating composition of this invention can contain, for increasing a burning rate, one or more types selected from metal oxides as a combustion controlling catalyst (e), as required. Examples of the metal oxide used as the combustion controlling catalyst of component (e) can include copper oxide, iron oxide, zinc oxide, cobalt oxide, manganese oxide and the like. The content of component (e) in the gas generating composition is preferably between 0.01 and 5% by weight, more preferably between 0.01 and 3% by weight.

The gas generating composition of this invention is especially preferably a gas generating composition comprising (a) 3 to 18% by weight of polyacrylamide, (b) 70 to 90% by weight of ammonium nitrate and (c) 0.5 to 15% by weight of bitetrazole potassium salt for solving the problems of this invention.

The gas generating composition of this invention can be molded into an article having a desired shape for forming the same into a mode capable of being packed in a gas generator (inflator). The shape of this molded article is not particularly limited. It can be formed into a cylindrical, single-hole cylindrical or porous cylindrical molded article which is obtained by adding water or an organic solvent to the gas generating composition according to the type of component (a), uniformly mixing them and extrusion-molding the mixture, a pellet-like molded article obtained by using a pelletizer or the like, a film-like molded article and so forth.

The gas generating composition of this invention can be applied to an air bag inflator for a driver side, an air bag inflator for a passenger side and a side inflator. Further, it can be applied to a hybrid inflator. With respect to the air bag inflator of the driver side, a gas output is high, and amounts of residues generated are reduced, so that a filter for filtering residues can be reduced to downsize an inflator. With respect to the hybrid inflator, the gas generating composition of this invention has an oxygen balance which is 0 or close to 0, so that an oxygen-free compression gas can be used.

In the method of this invention, the above-described gas generating composition is burned as a fuel in a gas generator, and an air bag is inflated using a gas generated by this burning.

EXAMPLES

This invention is illustrated specifically with reference to the following Examples. However, this invention is not limited to these Examples only. Incidentally, in Tables 1 to 3 below, PAA indicates polyacrylamide, CMCNa indicates sodium carboxymethyl cellulose, AN indicates ammonium nitrate, $CMCNH_4$ indicates ammonium carboxymethyl cellulose, BHTK bitetrazole potassium salt, BHTNa indicates bitetrazole sodium salt, $BHTNH_3$ indicates bitetrazole ammonium salt, C indicates carbon, CuO indicates copper oxide, and PSAN indicates phase-stabilized ammonium nitrate ($AN/KClO_4$:90/10). A composition ratio is expressed in terms of % by weight.

Examples 1 to 13 and Comparative Examples 1 and 2

Gas generating compositions each having a formulation shown in Table 1 were produced. With respect to these compositions, a combustion temperature, a generated gas efficiency (molar amount of a gas generated per 100 g of the composition), an amount of a residue formed (number of grams of a solid residue generated at room temperature when generating 1 mol of a gas) were measured. The results are shown in Table 1.

Examples 14 to 17

Gas generating compositions each having a formulation shown in Table 2 were produced. With respect to these compositions, a friction sensitivity and a drop hammer sensitivity according to an explosives performance test method of JIS K 4810-1979 were measured. The results are shown in Table 2.

In all examples, the friction sensitivity and the drop hammer sensitivity were much higher than 21 kgf and 30 cm respectively, deemed to be low sensitivities. The invention this way found to have a high safety.

Example 18

A gas generating composition having a formulation of PAA/AN/BHTK (8/83.5/8.5) was produced. This composition was molded into a strand having a diameter of 9.6 mm and a height of 12.5 mm. This strand was placed into a thermostat bath of 105° C., and a weight reduction ratio after the lapse of 400 hours was measured. As a result, the weight reduction ratio was 0.10%, and it was identified that the thermal stability was high.

Examples 19 to 25

Gas generating compositions each having a formulation shown in Table 3 were produced. Each of these compositions was molded into a strand, and a burning rate was measured under a nitrogen atmosphere of a pressure of 70 $kg/cm^2$. The results are shown in Table 3.

TABLE 1

| | Gas generating composition | Composition ratio | Combustion temperature (K) | Generated gas efficiency | Amount of residue generated |
|---|---|---|---|---|---|
| Ex. 1 | PAA/AN | 10.6/89.4 | 2131 | 4.25 | 0.00 |
| Ex. 2 | CMCNa/AN | 16.2/83.8 | 2177 | 4.12 | 0.67 |
| Ex. 3 | PAA/PSAN | 11.8/88.2 | 2161 | 4.04 | 1.14 |
| Ex. 4 | PAA/AN/BHTK | 10.0/88.1/1.9 | 2125 | 4.21 | 0.29 |
| Ex. 5 | PAA/AN/BHTK | 9.0/85.6/5.4 | 2116 | 4.15 | 0.82 |
| Ex. 6 | PAA/AN/BHTK | 8.0/83.5/8.5 | 2105 | 4.00 | 1.37 |
| Ex. 7 | PAA/AN/BHTNa | 9.0/86.3/4.7 | 2124 | 4.18 | 0.65 |
| Ex. 8 | PAA/AN/$BHTNH_3$ | 9.0/87.5/3.5 | 2187 | 4.27 | 0.00 |
| Ex. 9 | CMCNa/AN/BHTK | 13.9/81.1/5 | 2157 | 4.04 | 1.38 |
| Ex. 10 | cellulose acetate/AN/BHTK | 11.2/83.8/5 | 2270 | 4.09 | 0.78 |
| Ex. 11 | polyacetal/AN/BHTK | 13.5/81.5/5 | 2270 | 4.13 | 0.76 |
| Ex. 12 | PAA/AN/BHTK/CuO | 8.9/85.2/5.4/0.5 | 2111 | 4.13 | 0.93 |
| Ex. 13 | PAA/AN/BHTK/C | 7.6/86.4/5/1 | 2149 | 4.13 | 0.78 |
| CEx. 1 | sodium azide/CuO | 69/31 | 1374 | 1.59 | 35.14 |
| CEx. 2 | 5-amino-tetrazole/$KNO_3$ | 41/59 | 2115 | 2.40 | 16.33 |

Ex. - Example, CEx. - Comparative Example

TABLE 2

| | Gas generating composition | Composition ratio | Friction sensitivity kgf | Drop hammer sensitivity cm |
|---|---|---|---|---|
| Example 14 | $CMCNH_4$/AN | 14.9/85.1 | >36.0 | 30–40 |
| Example 15 | PAA/AN/BHTK | 8/83.5/8.5 | >36.0 | 50–60 |
| Example 16 | PAA/AN/$BHTNH_3$ | 8/86.3/5.7 | >36.0 | >100 |
| Example 17 | PAA/AN/BHTNa | 8/84.4/7.6 | >36.0 | 60–70 |

TABLE 3

| | Gas generating composition | Composition ratio | Burning rate (mm/sec) |
|---|---|---|---|
| Example 19 | PAA/AN | 10.6/89.4 | 2.52 |
| Example 20 | PAA/AN/$BHTNH_3$ | 8/86.3/5.7 | 3.16 |
| Example 21 | PAA/AN/BHTK | 8/83.5/8.5 | 8.58 |
| Example 22 | PAA/AN/BHTK | 9/85.4/5.6 | 7.46 |
| Example 23 | PAA/AN/BHTK | 10/88.08/1.92 | 5.14 |

TABLE 3-continued

| | Gas generating composition | Composition ratio | Burning rate (mm/sec) |
|---|---|---|---|
| Example 24 | PAA/AN/BHTNa | 8/84.4/7.6 | 6.95 |
| Example 25 | PAA/AN/BHTNa | 9/86.3/4.7 | 5.80 |

What is claimed is:

1. A gas generating composition comprising (a) 3 to 18% by weight of polyacrylamide, (b) 70 to 90% by weight of ammonium nitrate, and (c) 0.5 to 15% by weight of bitetrazole potassium salt.

2. The gas generating composition of claim 1, wherein component (b) is phase-stabilized ammonium nitrate.

3. The gas generating composition of claim 1, which further comprises (d) carbon or a metallic powder as a burning rate controlling agent.

4. The gas generating composition of claim 3, wherein component (d) is carbon.

5. The gas generating composition of claim 1, which further comprises (e) a metal oxide as a combustion catalyst.

6. The gas generating composition of claim 5, wherein component (e) is CuO.

7. A molded article comprising the gas generating composition according to claim 1.

* * * * *